US006305978B1

(12) United States Patent
Ko et al.

(10) Patent No.: US 6,305,978 B1
(45) Date of Patent: Oct. 23, 2001

(54) LOW PROFILE MINI COAXIAL CABLE CONNECTOR

(75) Inventors: David Tso-Chin Ko, Thousand Oaks; Rajagopalan Chandrasekhar, Huntington Beach, both of CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/578,349

(22) Filed: May 24, 2000

(51) Int. Cl.[7] ..... H01R 13/648
(52) U.S. Cl. ..... 439/579; 439/610
(58) Field of Search ..... 439/579, 610, 439/497

(56) References Cited

U.S. PATENT DOCUMENTS 4,365,856 * 12/1982 Yaegashi et al. ..... 439/579
4,379,608 * 4/1983 Olsson et al. .
4,602,832 * 7/1986 Cunningham et al. ..... 439/579
4,993,968 * 2/1991 Guletsky et al. ..... 439/579
5,085,596 * 2/1992 Bowen et al. ..... 439/497
5,241,135 * 8/1993 Fetzer ..... 439/579
5,871,369 * 2/1999 Ohayashi et al. .
5,980,308 * 11/1999 Hu et al. ..... 439/579
6,024,597 * 2/2000 Lok ..... 439/497
6,027,367 * 2/2000 Woertz et al. ..... 439/497

* cited by examiner

*Primary Examiner*—Gary Paumen
(74) *Attorney, Agent, or Firm*—Wei Te Chung

(57) ABSTRACT

A low profile mini coaxial cable connector 100 includes a contact set 10, a cable set 20, a grounding plate 30 a dielectric housing 40 and a metal shell 50. The contact set 10, the cable set 20 and the grounding plate 30 are fixedly accommodated in the housing 40 and the metal shell 50 encloses the housing 40. The metal shell 50 has two grounding tabs 513 electrically contacting the grounding plate 30. The metal shell 50 has an upper flap 51, a lower flap 52 and two side flaps 54, which extend from the upper flap 51 and which do not engage with but whose lower edges 541 are flush with side edges 523 of the lower flap 52. The housing 40 forms two buds 418 on two side surfaces thereof and each of the two side flaps 54 of the metal shell 50 defines a notch 517 which fixedly engages with a corresponding bud 418 of the housing 40 thereby reliably maintaining the metal shell 50 on the housing 40 and developing adequate normal force between the grounding tabs 513 and the grounding plate 30.

1 Claim, 10 Drawing Sheets

LOW PROFILE MINI COAXIAL CABLE CONNECTOR

BACKGROUND OF THE INVENTION

1. Field of the Invention

The present invention relates to an electrical connector, and particularly to a mini coaxial cable connector having a relatively low profile.

2. Brief Description of the Prior Art

It is well known in the electrical connector field, particularly in the high frequency communication connector field, that metal shells can be widely used to enclose a dielectric housing and a plurality of contacts received in the housing for reducing the effects of external electromagnetic interference on the signal transmitted through the connector. There are many ways to connect the metal shell to a reference potential, such as to the earth. One way is to form several tabs on the metal shell which electrically connect to a grounding plate of the connector, which in turn electrically connect to the reference potential. The grounding tabs must provide an adequate normal force to ensure that free ends thereof reliably contact the grounding plate. In order to obtain adequate normal force, the metal shell is usually stamped and formed by first stamping a metal plate to get a flat shell and then by bending the flat shell to get a final shell. The final shell usually comprises a portion having two or more layers of plate stacked one above the other, which adds significantly to profile height of the connector. This is unacceptable for a mini cable connector, which must have only a very limited profile height. Hence, an improved low profile mini coaxial cable connector is required to overcome the disadvantages of the prior art. The U.S. Pat. No. 6,123,582 issued Sep. 26, 2000 with the same inventor and the same assignee discloses the related art.

BRIEF SUMMARY OF THE INVENTION

A first object of the present invention is to provide a mini coaxial cable connector having a very low profile;

A second object of the present invention is to provide a low profile mini coaxial cable connector having a grounding shell providing grounding tabs which provide adequate normal force against a grounding plate of the cable connector thereby providing a reliable electrical connection thereto.

To achieve the above-mentioned objects, a low profile mini coaxial cable connector of the present invention includes a dielectric housing, a contact set and a cable set electrically connected together, a grounding plate and a metal shell. The contact set, the cable set and the grounding plate are fixedly accommodated in the housing and the metal shell encloses the housing. The metal shell has two grounding tabs electrically contacting the grounding plate. The metal shell has an upper flap, a lower flap and two side flaps extending from the upper flap which do not engage with the lower flap but are flash with side edges of the lower flap. The housing forms two buds on two side surfaces thereof and each of the two side flaps of the metal shell defines a notch fixedly engaging with a corresponding bud of the housing thereby reliably fixing the metal shell to the housing and developing adequate normal force between the grounding tabs and the grounding plate.

Other objects, advantages and novel features of the present invention will become more apparent from the following detailed description of the present embodiment when taken in conjunction with the accompanying drawings.

DETAILED DESCRIPTION OF THE PRESENT INVENTION

Figure 1:
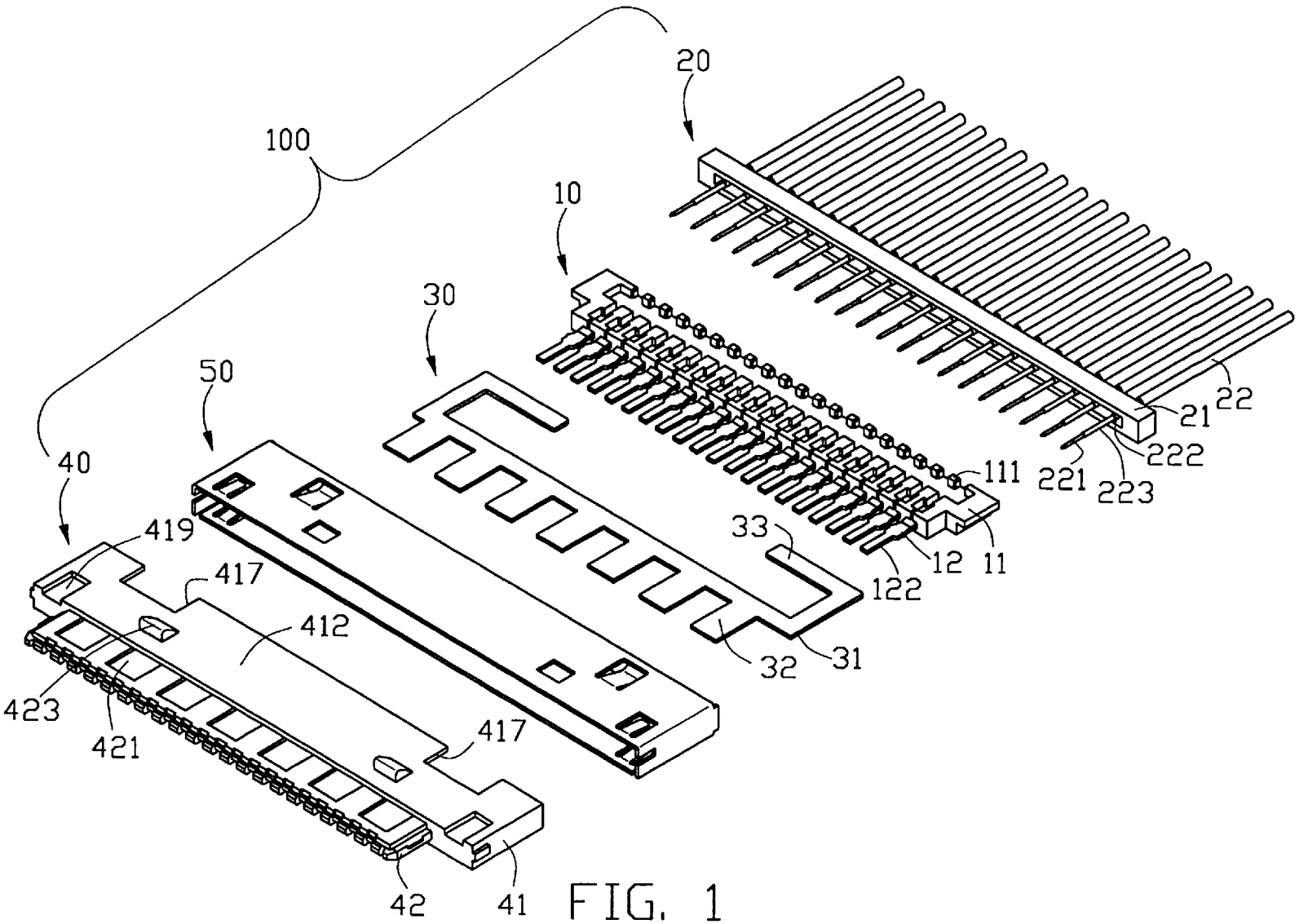
FIG. 1 is an exploded view of a mini coaxial cable connector assembly of the present invention.

Referring to FIG. 1, a low profile mini coaxial cable connector assembly 100 of the present invention includes a contact set 10, a cable set 20 fixed to the contact set 10, a conductive grounding plate 30 mounted on the cable set 20, a dielectric housing 40 fixedly receiving the contact set 10, the cable set 20 and the grounding plate 30 therein, and a metal shell 50 partially shrouding the housing 40.

The contact set 10 includes a dielectric insert 11 and a plurality of conductive contacts 12 fixedly retained in the insert 11 via an engagement of tail portions 121 (FIG. 4) of the conductive contacts 12 with the insert 11 while contact portions 122 of the contacts 12 extend beyond the insert 11. The insert 11 forms a plurality of retainers 111 arranged in a row at a rear portion thereof for retaining the cable set 20 in fixed position with the insert.

The cable set 20 includes a conductive grounding bar 21 and a plurality of coaxial cables 22 each having a front end portion extending through the grounding bar 21. Details of the cable set 20 are disclosed in a co-pending application titled "MICRO CONNECTOR ASSEMBLY AND THE METHOD OF MAKING THE SAME", which was issued on Oct. 31, 2000 as U.S. Pat. No. 6,139,693 and is incorporated herein by reference.

The grounding plate 30 has a connecting section 31, a plurality of grounding fingers 32 and a pair of grounding beams 33 extending from two opposite ends of the connecting section 31. Each of the grounding beams 33 is generally in the shape of the letter L so that a free end thereof may reliably engage with the grounding bar 21.

Figure 2:
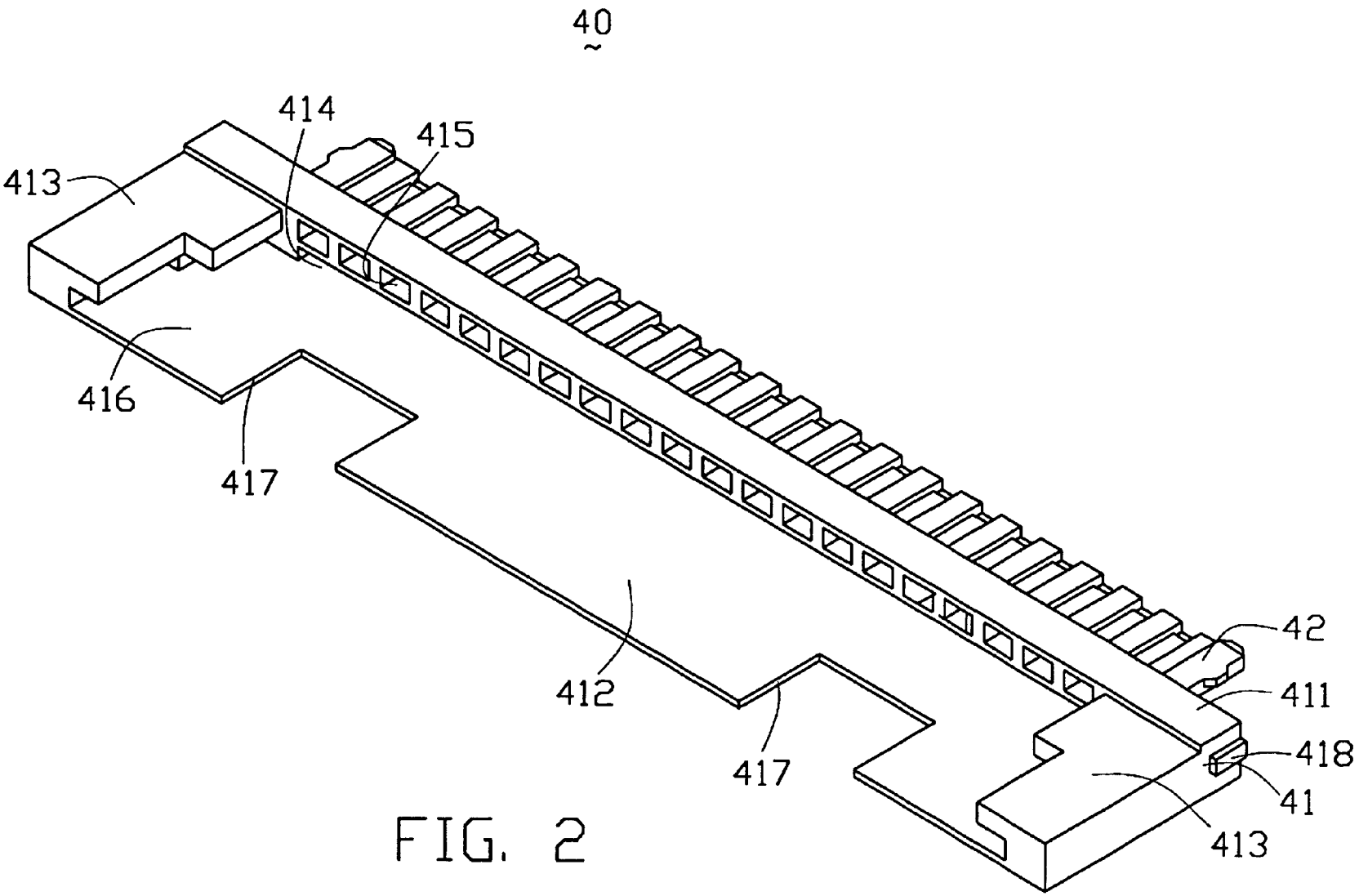
FIG. 2 is an enlarged perspective view of a dielectric housing of FIG. 1 but viewed from a different perspective.

Further referring to FIG. 2, the housing 40 includes a body portion 41 and a tongue portion 42 extending forwardly from the body portion 41. The body portion 41 further includes an elongate rod 411, a panel 412 extending rearwardly from a top surface of the rod 411 and two lateral bars 413 extending rearwardly from two lateral sides of the rod 411 and integral with opposite lateral side edges of the panel 412. A slit 414 is defined between the rod 411 and the panel 412 along a central segment of the rod 411 such that the grounding plate 30 may extend therethrough. The rod 411 defines a plurality of cavities 415 therethrough which further extend into a bottom surface of the tongue portion 42 for fixedly receiving the contact portions 122 of the contacts 12 therein. The body portion 41 defines a chamber 416 between the two lateral bars 413. The panel 412 defines two cutouts 417 adjacent two lateral edges thereof. Each of the two lateral bars 413 forms a bud 418 on a lateral surface thereof adjacent to a front end of the lateral bars 413. The body portion 41 defines two retention recesses 419 in a top surface adjacent to opposite lateral ends of the body portion, respectively. The tongue portion 42 defines a plurality of grooves 421 in a top surface thereof. The grooves 421 are in communication with the slit 414 so that the grounding fingers 32 of the grounding plate 30 can extend through the slit 414 to be received in the grooves 421.

Figure 3:
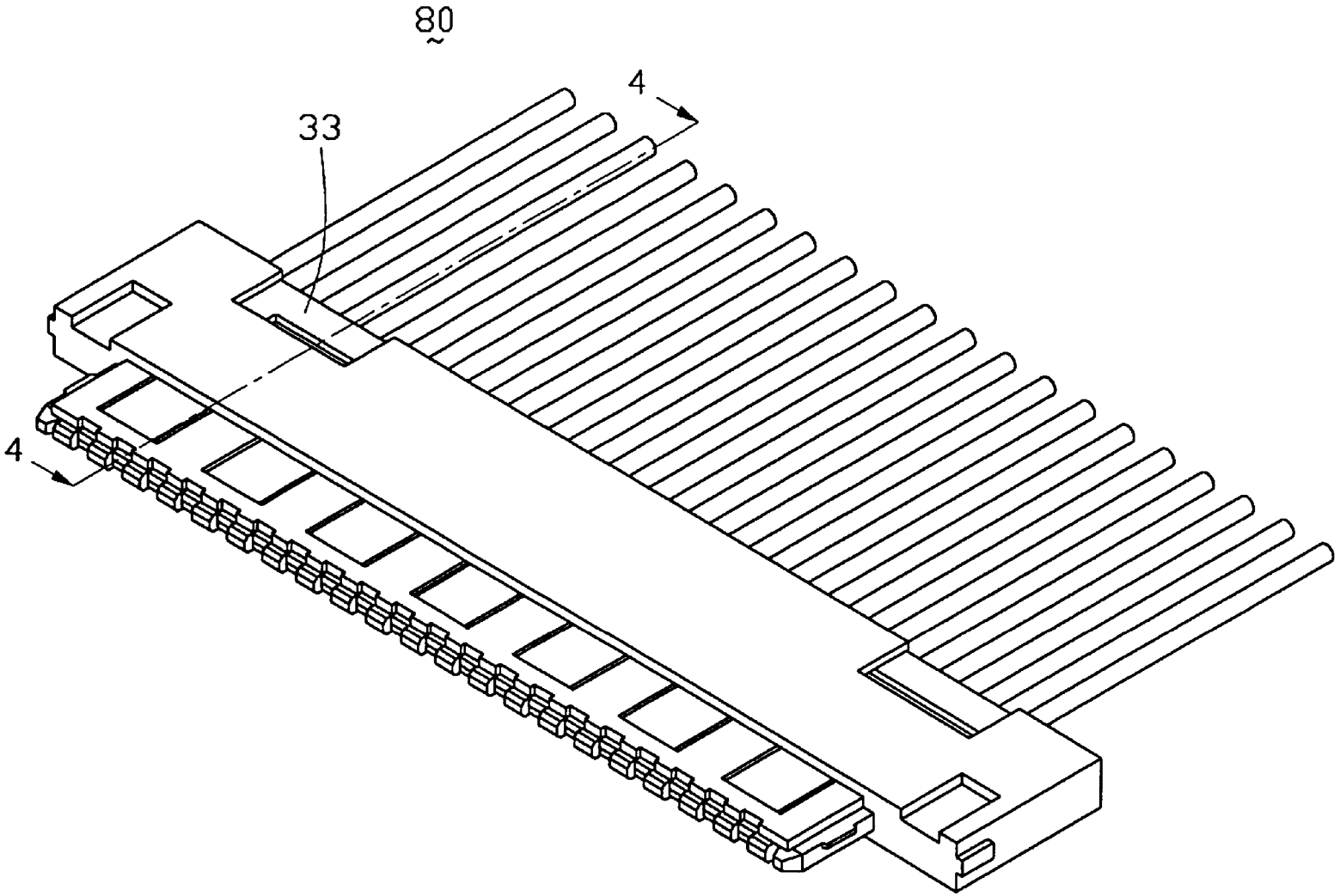
FIG. 3 is a partly assembled view of FIG. 1 while a metal shell is removed therefrom.
Figure 4:
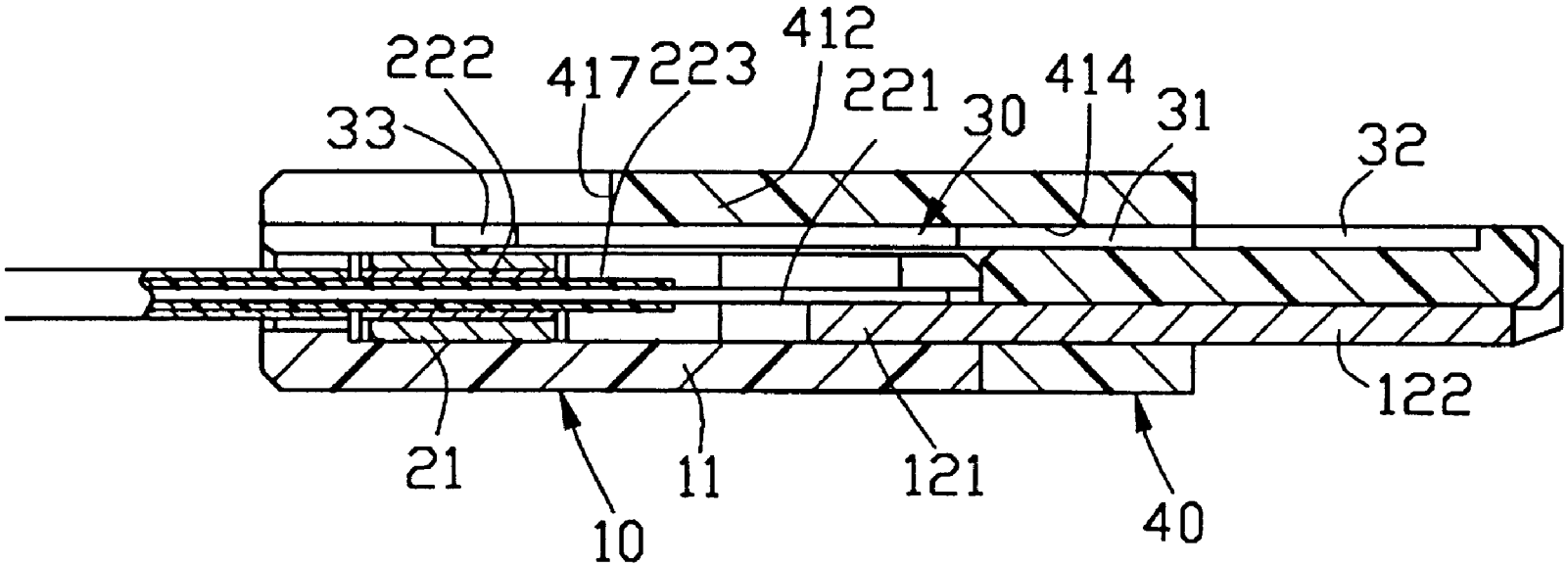
FIG. 4 is a cross-sectional view of the subassembly of FIG. 3 taken along line 4—4 of FIG. 3.
Figure 5:
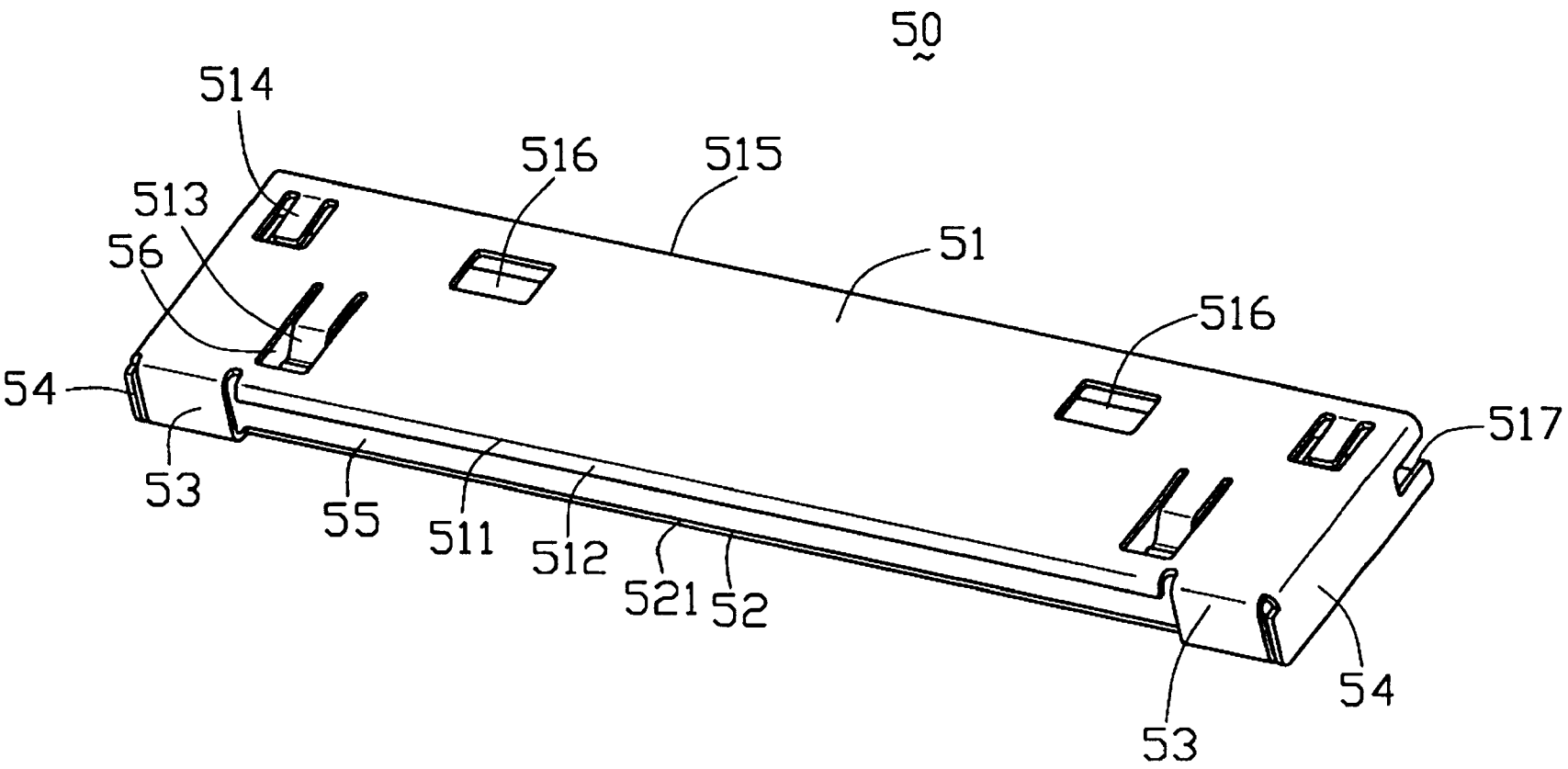
FIG. 5 is a rear perspective view of the metal shell of FIG. 1.
Figure 6:
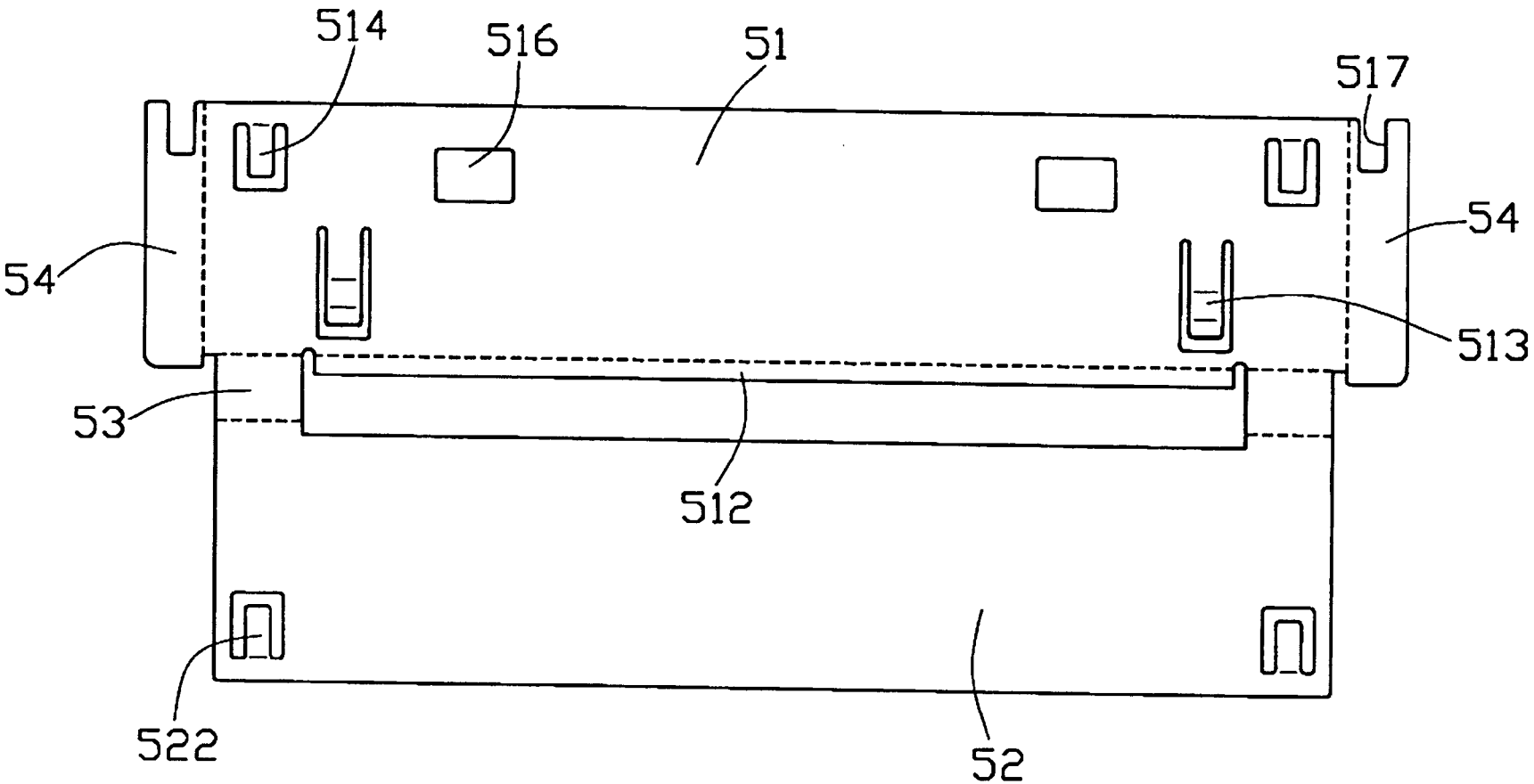
FIG. 6 is a top planar view of the metal shell of FIG. 5 in an unfolded configuration.

Also referring to FIGS. 3 and 4, a subassembly 80 of the contact set 10, the cable set 20, the grounding plate 30 and the housing 40 is illustrated. The cable set 20 fixedly engages with the rear portion of the contact set 10, each cable 22 being arranged between two adjacent retainers 111 and the conductive cores 221 of the cables 22 being electrically connected to the tail portions 121 of the contacts 12, respectively (see FIG. 4). A metal braid 222 of each coaxial cable 22 is electrically connected to the grounding bar 21 while a dielectric layer 223 is located between the conductive core 221 and the metal braid 222 of each cable 22. The grounding plate 30 is positioned above the contact set 10 while the grounding beams 33 electrically engage with the grounding bar 21. The contact set 10 together with the cable set 20 and the grounding plate 30 is engageably received in the chamber 416 of the housing 40 while contact portions 122 of the contacts 12 are fixedly received in the corresponding cavities 415 of the housing 40 and expose from the bottom surface of the tongue portion 42. The connecting section 31 of the grounding plate 30 is received in the slit 414 of the housing 40 with the grounding fingers 32 fixedly received in the corresponding grooves 421 of the tongue portion 42.

Figure 7:
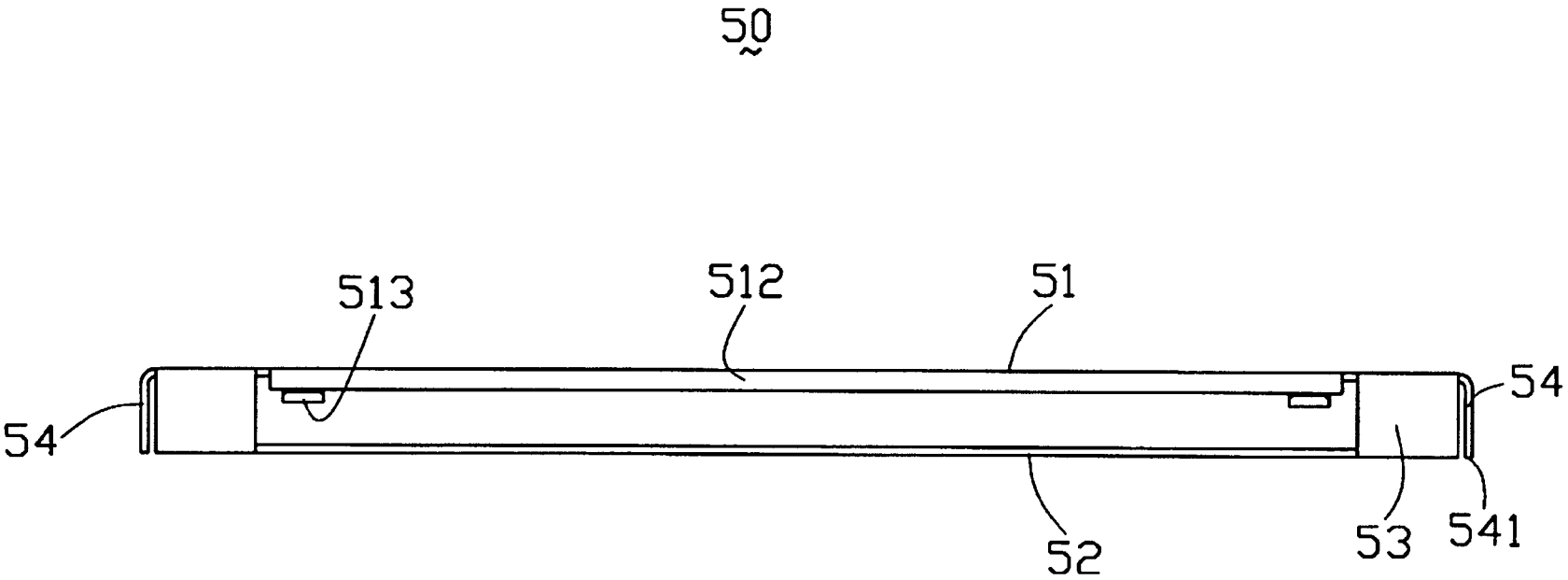
FIG. 7 is a rear planar view of FIG. 5.
Figure 8:
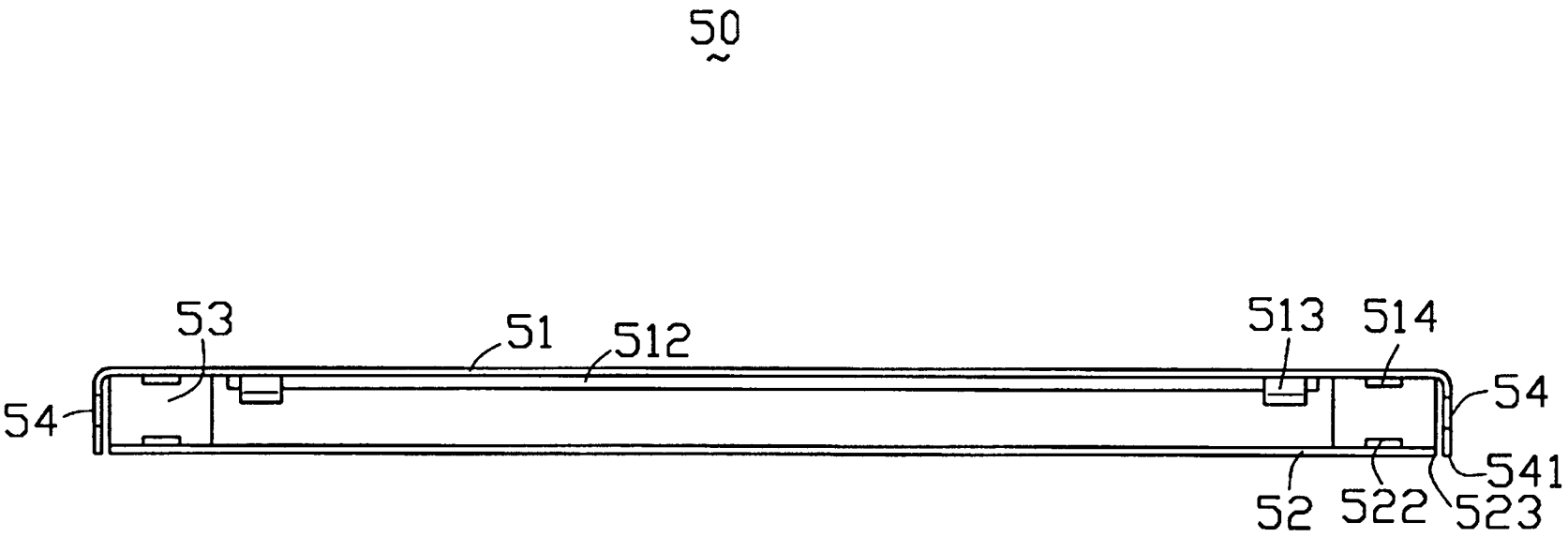
FIG. 8 is a front planar view of FIG. 5.

Referring to FIGS. 1 and 5–8, the metal shell 50 is illustrated in great detail. The metal shell 50 is stamped and bent from a piece of metal plate and comprises an upper flap 51, a lower flap 52 confronting the upper flap 51, a pair of connecting tabs 53 and a pair of side flaps 54 downwardly extending from opposite side edges of the upper flap 51. The connecting tabs 53 connect rear edges 511, 521 of the upper and lower flaps 51, 52 and are located adjacent to the opposite side edges of the upper and lower flaps 51, 52 while a port 55 is defined therebetween. The upper flap 51 has a tabshaped flange 512 which downwardly extends from the rear edge 511 of the upper flap 51. The upper flap 51 forms a pair of grounding tabs 513 and a pair of upper retention tabs 514 downwardly extending into a chamber 56 defined between the upper and lower flaps 51, 52. The pair of grounding tabs 513 are adjacent to the rear edge 511 of the upper flap 51 while the pair of upper retention tabs 514 are adjacent to a front edge 515 of the upper flap 51. The upper flap 51 further defines two openings 516 adjacent to the front edge 515 thereof. Referring to FIGS. 7 and 8, particularly, lower edges 541 of the side flaps 54 do not engage with the lower flap 52 and are generally flush with the opposite side edges 523 of the lower flap 52. In other words, the lower edges 541 of the side flaps 54 are not further bent to overlap the opposite edges 523 of the lower flap 52, and thus do not increase the height of the mini cable connector 100. Therefore, the profile of the mini cable connector 100 is relatively low. In order to maintain the upper flap 51 secured on the housing 40, each of the two side flaps 54 defines a notch 517 in a front edge thereof corresponding to the bud 418 of the housing 40. The lower flap 52 defines a pair of lower retention tabs 522 fixedly engaging with a bottom of the housing 40 thereby retaining the lower flap 52 on the housing 40.

Figure 9:
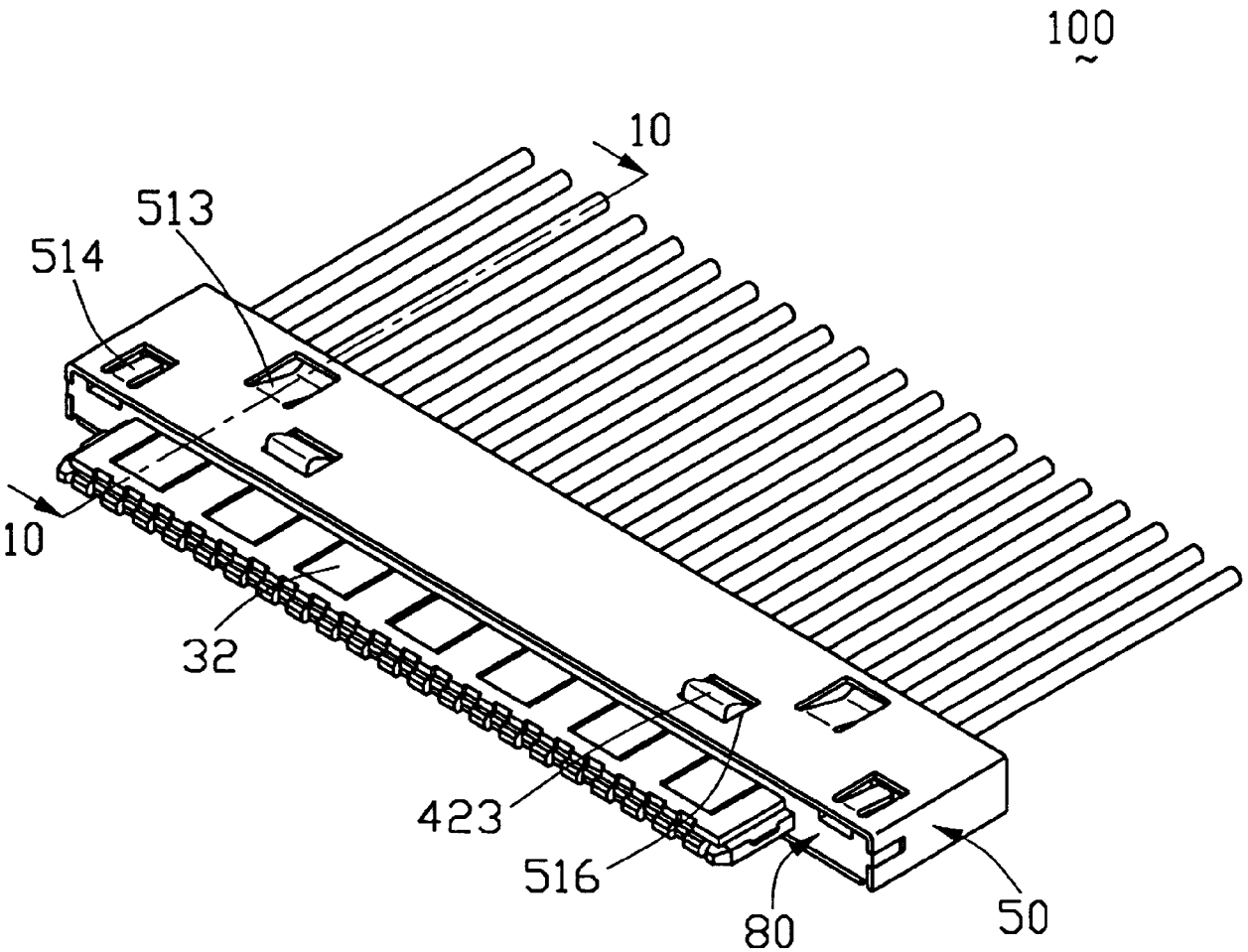
FIG. 9 is a fully assembled perspective view of FIG. 1.
Figure 10:
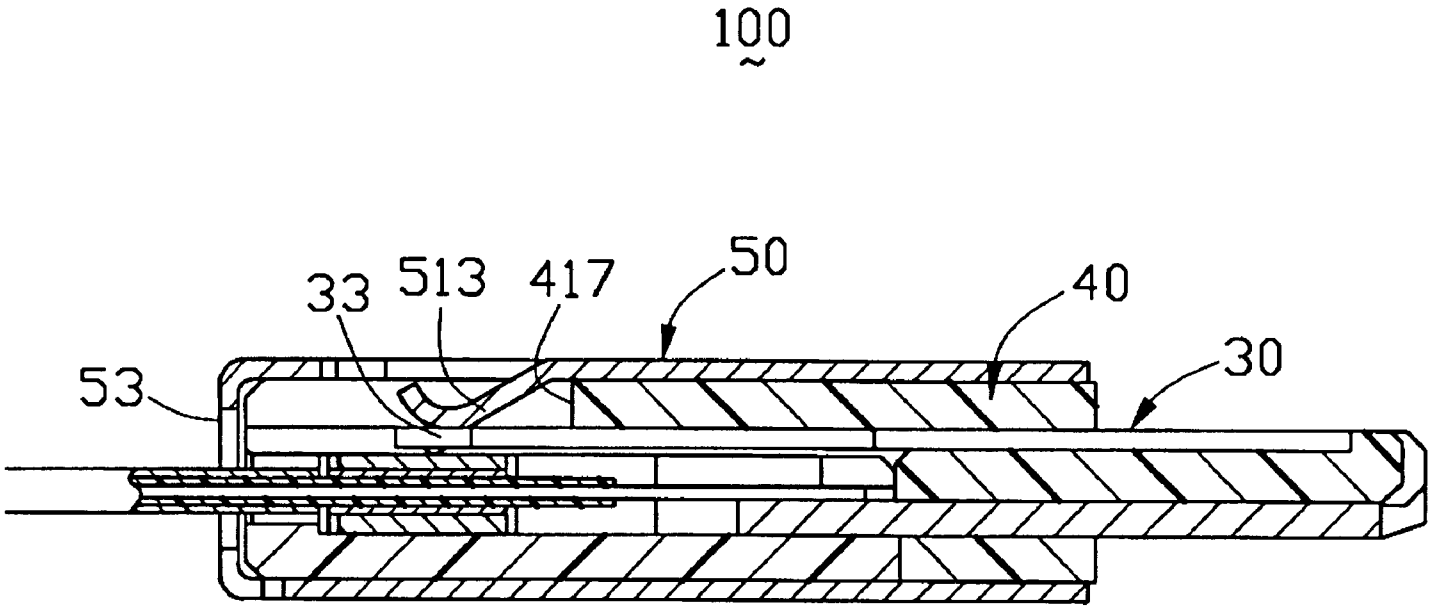
FIG. 10 is a cross-sectional view of the assembled mini coaxial cable connector taken along line 10—10 of FIG. 9.

Referring to FIGS. 9 and 10 now, the assembled mini coaxial cable connector 100 is illustrated. After the subassembly 80 (see FIGS. 3 and 4) reliably engaged with the metal shell 50, the pair of connecting tabs 53 generally abut against a rear surface of the body portion 41 of the housing 40. The pair of openings 516 engageably receive a pair of blocks 423 of the housing 40 and the upper retention tabs 514 are engageably received in the retention recesses 419, respectively. The pair of grounding tabs 513 respectively extend through the pair of cutouts 417 of the housing 40 to electrically and resiliently contact the corresponding grounding beams 33 of the grounding plate 30. The pair of notches 517 engageably receive the corresponding buds 418 of the housing to prevent an upward disengagement of the upper flap 51 from the housing 40, whereby the normal force exerted by the pair of grounding tabs 513 against the grounding beams 33 is maintained. Since the metal shell 50 electrically contacts the grounding plate 30 via the pair of grounding tabs 513 and the metal braids 222 of the coaxial cables 22 electrically contacts the grounding plate 30 via the grounding bar 21, a grounding path is obtained from the metal braids 222 to a mated external device's ground when the grounding fingers 32 of the grounding plate 30 engage with corresponding grounding elements of a grounded external device (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A low profile mini coaxial cable connector comprising:

a contact set having a dielectric insert and a plurality of conductive contacts fixedly received in the insert, each contact having a contact portion extending beyond the insert;

a cable set having a plurality of coaxial cables and a conductive grounding bar retaining the cables, each coaxial cable having a conductive core, a metal braid and a dielectric layer between the conductive core and the metal braid, said conductive core being electrically engaged with a corresponding contact and said metal braid being electrically engaged with the grounding bar;

a grounding plate having a plurality of grounding fingers and at least one grounding beam, said at least one grounding beam electrically contacting the grounding bar of the cable set;

an insulative housing having a panel defining at least one cutout therein and two opposite lateral bars, said housing fixedly accommodating the contact set, the cable set and the grounding plate therein; and a metal shell enclosing the housing, said metal shell having an upper flap, a lower flap and a pair of side flaps downwardly extending from opposite side edges of the upper flap, said upper flap forming at least one grounding tab extending through the at least one cutout of the housing and electrically contacting the at least one grounding beam of the grounding plate, said pair of side flaps reliably engaging with said two opposite lateral bars of the housing and lower edges of the pair of side flaps not engaging with but being generally flush with opposite respective side edges of the lower flap whereby a total profile of the cable connector substantially equals a distance between a top face of the upper flap and a bottom face of the lower flap;

wherein the housing forms two buds on the two opposite lateral bars thereof, respectively, and each of the two side flaps of the metal shell defines a notch corresponding to one of the buds, said notches engaging with the corresponding buds, thereby preventing the upper flap from disengaging from the housing;

wherein the housing comprises a body portion which includes the panel and a rod positioned at an edge of the panel, said housing defining a slit between the panel and the rod through which the grounding fingers of the grounding plate extend;

wherein the housing comprises a tongue portion extending from the body portion, said tongue portion defining a plurality of cavities and a plurality of grooves in opposite surfaces thereof in which the plurality of contact portions and the plurality of grounding fingers are received, respectively;

wherein each contact has a tail portion fixedly received in the insert, the tail portion electrically contacting the conductive core of a corresponding cable;

wherein the grounding bar of the cable set is fixedly retained on the dielectric insert of the cable set;

wherein the grounding plate is located above the contact set in the assembled connector.

* * * * *